US008018479B2

(12) United States Patent
Hadady et al.

(10) Patent No.: US 8,018,479 B2
(45) Date of Patent: Sep. 13, 2011

(54) METHOD AND SYSTEM FOR CORRECTING THE LINEARITY ERROR IN ELECTROPHOTOGRAPHIC DEVICES

(75) Inventors: Craig Eric Hadady, Lexington, KY (US); Christopher Dane Jones, Georgetown, KY (US); John Lemaster, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 47 days.

(21) Appl. No.: 12/199,292

(22) Filed: Aug. 27, 2008

(65) Prior Publication Data

US 2010/0053298 A1 Mar. 4, 2010

(51) Int. Cl.
*B41J 2/435* (2006.01)
*B41J 2/47* (2006.01)

(52) U.S. Cl. ..... 347/234; 347/248

(58) Field of Classification Search ..... 347/229, 347/234, 235, 248–250
See application file for complete search history.

(56) References Cited

U.S. PATENT DOCUMENTS

| | | | | |
|---|---|---|---|---|
| 6,362,847 | B1 * | 3/2002 | Pawley et al. | 347/234 |
| 7,206,012 | B2 | 4/2007 | Cook et al. | |
| 7,349,123 | B2 | 3/2008 | Clarke et al. | |
| 7,375,738 | B2 | 5/2008 | Corbett et al. | |
| 7,502,140 | B2 * | 3/2009 | Yamamura | 358/1.9 |
| 7,639,407 | B2 * | 12/2009 | Clarke et al. | 358/474 |
| 2005/0212905 | A1 | 9/2005 | Clarke et al. | |
| 2008/0089585 | A1 * | 4/2008 | Yashima et al. | 382/173 |

* cited by examiner

*Primary Examiner* — Hai C Pham

(57) ABSTRACT

The invention describes a method and system for correcting linearity error of an electrophotographic device with a reduced number of lenses. The method and system insert additional time-slices in the data being processed by the electrophotographic device. The additional time-slices are inserted in the data in a predefined order based on a plurality of random numbers. The insertion of additional time-slices corrects the linearity error of the electrophotographic device.

15 Claims, 12 Drawing Sheets

FIG. 1 *(Prior Art)*

METHOD AND SYSTEM FOR CORRECTING THE LINEARITY ERROR IN ELECTROPHOTOGRAPHIC DEVICES

CROSS REFERENCES TO RELATED APPLICATIONS

This patent application is related to the U.S. patent application Ser. No. 10/808,130, filed Mar. 24, 2004, entitled "Systems For Performing Laser Beam Linearity Correction And Algorithms And Methods For Generating Linearity Correction Tables From Data Stored In An Optical Scanner" and assigned to the assignee of the present application.

BACKGROUND

1. Field of the Invention

The present invention relates generally to electrophotographic devices and electrophotographic printing methods, and more particularly, to a method and system for correcting a linearity error in the electrophotographic devices.

2. Description of the Related Art

An electrophotographic device produces an image or a copy of a document containing text, graphics, or a combination thereof. Examples of the electrophotographic devices include, but are not limited to, laser printers and laser copiers. The electrophotographic device produces the image by causing light to affect an electrostatic charge distribution on a photoconductive surface. The device includes a Photo Conducting (PC) drum (also referred to as photoconductor drum) which acts as an image-carrier and is coated with a photoconductive material. The device also includes a light source such as a laser beam or an array of Light Emitting Diodes (LED). The surface of the PC drum is exposed to the light from the light source to neutralize the electrostatic charge on the non-image parts of the PC drum. The density of the electrostatic charge on the surface of the PC drum is altered in the areas exposed to the laser beam relative to the areas unexposed to the laser beam. This process leaves a static electric-charged image on the surface of the PC drum to lift the toner particles. The toner particles are then transferred to different print media by electrostatic attraction.

The laser beam is directed towards the PC drum by passing the laser beam through a series of lenses and mirrors. The laser beam is first directed towards a rotating polygon mirror, which further directs the beam towards a series of lenses and mirrors. The laser beam, the rotating polygon mirror, and the series of lenses and mirrors are collectively known as a Laser Scanning Unit (LSU). The polygon mirror rotates with the help of a motor known as polygon mirror motor.

The laser beam moves across the surface of the PC drum in a uniform manner. For every small increment in the motion of the polygon mirror, the laser beam moves the same distance on the PC drum. The PC drum keeps rotating and the laser beam sweeps across the PC drum at an angle, to compensate for the motion of the drum, and makes a sweep straight across the page. A stream of rasterized data, including a series of 0's and 1's, is used to turn the laser on and off across the PC drum.

The laser beam that has a linear scan motion scans or sweeps the surface on a row-by-row basis. It moves linearly across the page and is turned on or off depending on the data bits (either one or zero). The laser beam takes more time to copy the image to the edges of the document, as compared to its center. Due to the difference in the speed of the laser beam (or beam velocity), a linearity error is generated. Further, manufacturing tolerances and imperfections of optical devices used by the LSU also generate the linearity error. The linearity or beam location or scan-location-error of the LSU describes the manner in which the laser beam moves across the PC drum when the rotating mirror spins at a fixed angular speed.

In a typical LSU, the rate at which the laser beam moves across the PC drum is relatively constant, since the polygon mirror rotates at a constant velocity. In such a system, when the laser is activated with a fixed time between activation periods, i.e., the time of turning the laser 'on' is fixed, the image containing equally spaced marks is printed correctly. This system is characterized by very low (<1 percent) linearity error. However, electrophotographic scanners and copiers with linearity error less than one are costly. Therefore, it is desirable to reduce the cost of such systems and also make sure that the linearity error is minimized.

To reduce the cost of the electrophotographic device, a set of lenses used to guide light beams on the PC drum can be removed from the electrophotographic device. However, for such low-cost electrophotographic devices, the linearity error increases to 15 percent or more. As a result of high linearity error in such systems, the placement of evenly spaced marks on the page is not accomplished by firing the laser at fixed time intervals. Various techniques are employed to ensure that the images are printed without any defects. Typical techniques used to correct the low linearity error include the use of a non-constant pel clock or a constant pel clock with 'off' slice insertion. The use of such techniques to correct the increased linearity error results in producing print artifacts in the form of narrow streaks in the print output obtained from the electrophotographic device.

In light of the facts given above, there is a need for a system and a method to correct the linearity error of the electrophotographic devices with a reduced number of lenses. Further, such a method and system should remove the print artifacts and also prove to be cost effective.

SUMMARY OF THE INVENTION

The invention provides a method, system and computer program product for correcting the linearity error of an electrophotographic device with a reduced number of lenses. The electrophotographic device processes the data including a plurality of scan lines. Each of the scan lines includes a plurality of pels, and each of the pels includes a plurality of time-slices. The method for correcting the linearity error includes computing one or more time-slices, based on one or more properties of the electrophotographic device. Thereafter, a plurality of random numbers is added to the time-slices. Subsequently, one or more time-slices are inserted in the data in a predefined order, based on the addition of the plurality of random numbers to the time-slices. The insertion of the time-slices in the data corrects the linearity error of the electrophotographic device.

The electrophotographic device includes a system, hereinafter referred to as linearity error-correction system, for correcting the linearity error of the electrophotographic device. The linearity error-correction system includes a first computation module, an addition module, a second computation module, and a slice-insertion module. The first computation module computes one or more total time-slices corresponding to one or more regions of the data, each region including a predefined number of pels. The computation of the total time-slices is based on a first predefined criterion. Thereafter, the addition module adds a plurality of random numbers to the total time-slices. Further, the second computation module computes a plurality of scan insertion vectors, based on the addition of the plurality of random numbers to the total time-slices. Each of the scan insertion vectors includes a plurality of tokens, each token corresponding to a particular region of the data. Subsequently, the slice-insertion module inserts one or more time-slices in the regions of the data, based on the multiple tokens. The time-slices are inserted in the data in a predefined order, based on the plurality of random numbers. The insertion of the additional time-slices in the data corrects the linearity error of the electrophotographic device.

The method and system correct the linearity error of the electrophotographic device by inserting additional time-slices in the data processed by the electrophotographic device. The time-slices are inserted in a unique order varying across each scan line and also within a single scan line, which thereby minimizes the print artifacts. Therefore, the method and system correct the linearity error without compromising with the print quality. Moreover, the method and system are used by the electrophotographic device with a reduced number of lenses and therefore reduce the cost of the electrophotographic device.

BRIEF DESCRIPTION OF THE DRAWINGS

The features and advantages of this invention mentioned above, as well as others, and the manner of attaining them will become more apparent, and the invention will be better understood by reference to the following description of the embodiments of the invention taken in conjunction with the accompanying drawings, wherein.

DETAILED DESCRIPTION

Figure 1:
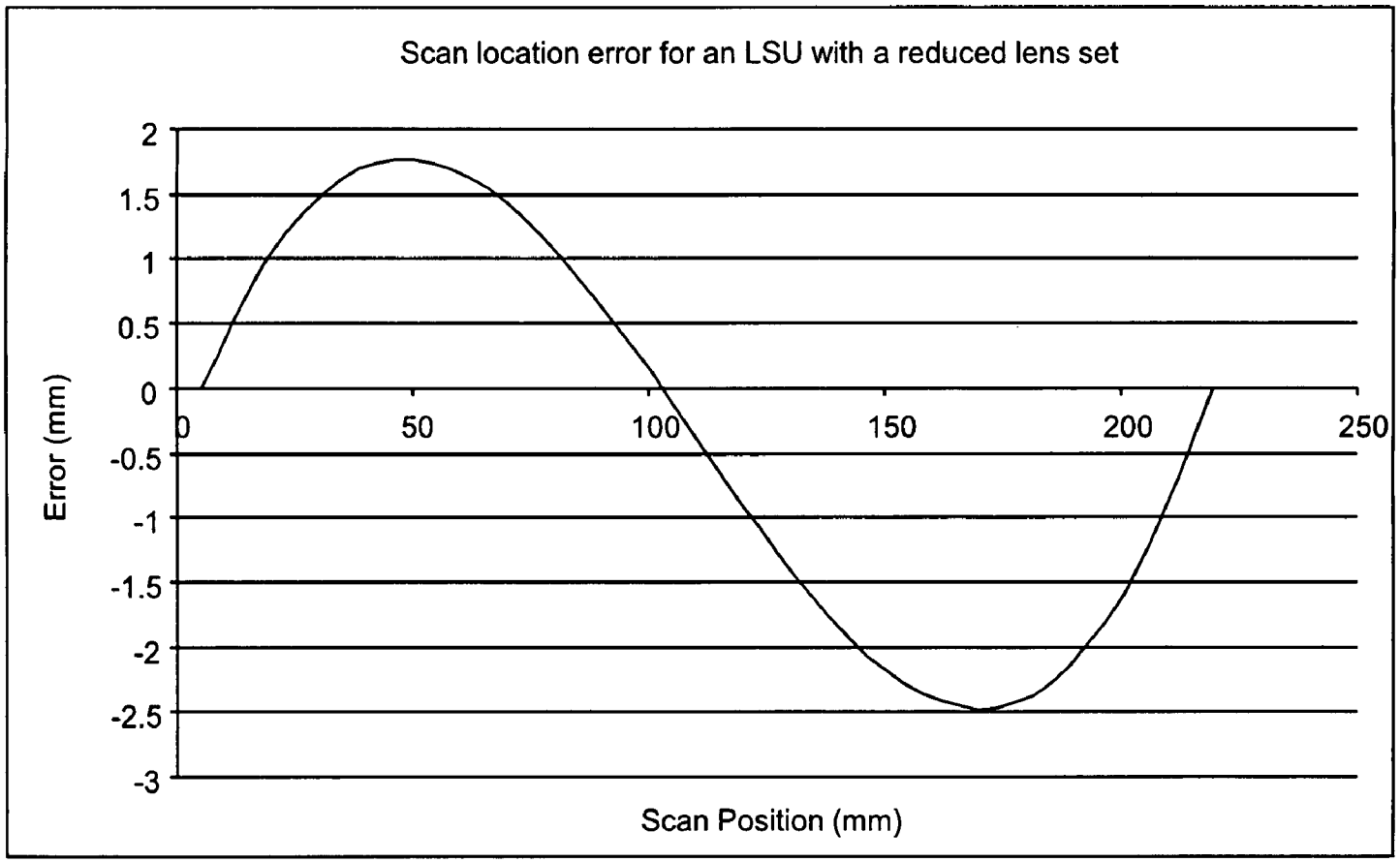
FIG. 1 is a graphical illustration of a linearity error for a Laser Scanning Unit (LSU) of an electrophotographic device.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising,", "containing" or "having" and variations thereof herein is meant to encompass the items listed thereafter and equivalents thereof as well as additional items.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The present invention provides a method, system, and computer program product for correcting a linearity error in an electrophotographic device. The invention provides a method, system and computer program product for correcting the linearity error of an electrophotographic device with a reduced number of lenses. The electrophotographic device processes the data including a plurality of scan lines. Each of the scan lines includes a plurality of pels, and each of the pels includes a plurality of time-slices. The method for correcting the linearity error includes computing one or more time-slices, based on one or more properties of the electrophotographic device. Thereafter, a plurality of random numbers is added to the time-slices. Subsequently, one or more time-slices are inserted in the data in a predefined order, based on the addition of the plurality of random numbers to the time-slices. The insertion of the time-slices in the data corrects the linearity error of the electrophotographic device.

The term image as used herein encompasses any printed or digital form of text, graphic, or combination thereof. The term, electrophotographic device, as used herein, encompasses devices such as color and black-and-white copiers, color and black-and-white printers, and so-called "all-in-one devices" that incorporate multiple functions such as copying, and printing capabilities in one device. The term output as used herein encompasses output from any electrophotographic device.

FIG. 1 is a graphical illustration of a linearity error for a Laser Scanning Unit (LSU) of an electrophotographic device, as known in the art. In the LSU, a laser creates an image on a photoconductor drum of the electrophotographic device in a scan direction, which is defined by a straight line (known as scan line) perpendicular to a process direction. The process direction is defined as the direction of the movement of print media relative to the movement of the photoconductor drum. The velocity of the laser beam varies across the scan line, thereby generating the linearity or scan-location-error, also referred to as scan line non-linearity. The linearity error causes consecutive pels or print elements to be written farther apart near the ends of the scan line and closer together in the middle portion of the scan line.

The linearity error of the LSU increases with a reduction in the number of lenses used by the LSU. FIG. 1 graphically illustrates the scan-location-error for an LSU with a reduced lens set. The scan-location-error is depicted for different scan positions, i.e., for different positions of the laser beam on the photoconductor drum. The scan position is expressed in millimeters. It will be evident to a person skilled in the art that any suitable unit of measure, for example, microns and millimeters, may be used to measure the scan position. The graph illustrates that the value of the scan-location-error varies from +1.8 mm to −2.5 mm. The scan-location-error of value 0 indicates that the laser beam is at the correct scan position on the photoconductor drum. The scan-location-error of +1.8 mm depicts that the laser beam is 1.8 mm behind the correct scan position, whereas the scan-location-error of −2.5 mm depicts that the laser beam is 2.5 mm ahead of the correct scan position on the page, and vice-versa.

Figure 2:
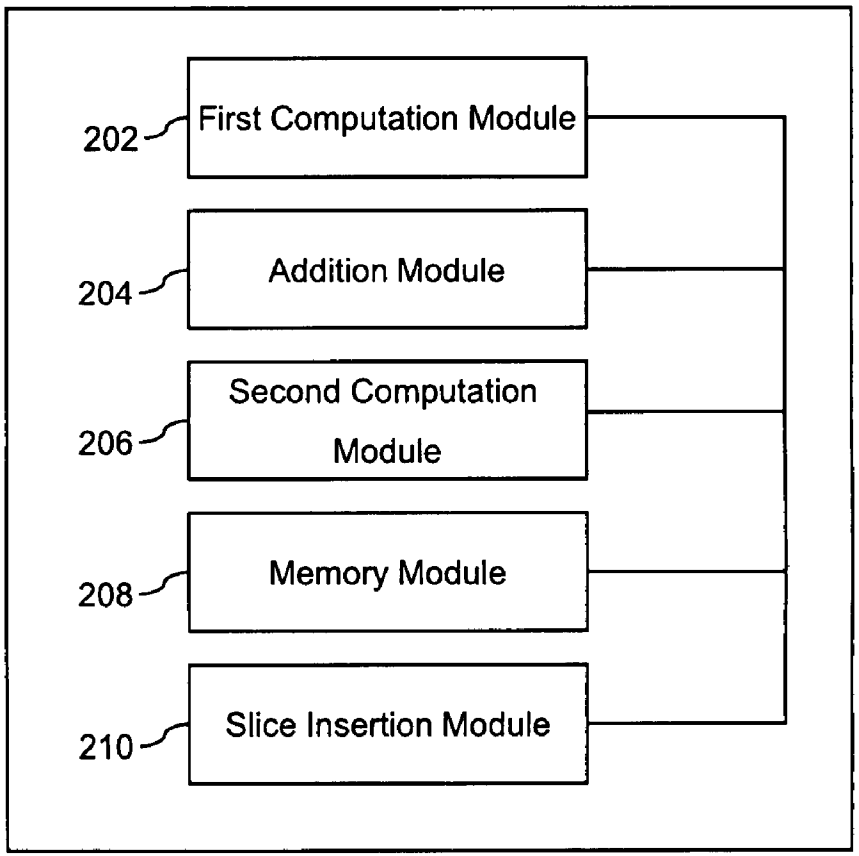
FIG. 2 is a block diagram illustrating a system for correcting the linearity error of the electrophotographic device, in accordance with an embodiment of the invention.

FIG. 2 is a block diagram illustrating a system 200, hereinafter referred to as a linearity error-correction system 200, for correcting the linearity error of the electrophotographic device, in accordance with an embodiment of the invention. Linearity error-correction system 200 includes a first computation module 202, an addition module 204, a second computation module 206, a memory module 208, and a slice-insertion module 210.

A user provides one or more documents to the electrophotographic device for printing. Each document contains data in the form of text, graphics, or combinations thereof. The data includes a plurality of pels. Each pel includes a plurality of time-slices, which are sub-units of time and are also referred to as 'time increments'. The electrophotographic device produces a linearity error while printing the documents. Further, by reducing the number of lenses used by the electrophotographic device, the linearity error increases to the magnitude of 15 percent or more. Linearity error-correction system 200 corrects the linearity error for electrophotographic devices with a reduced set of lenses. The electrophotographic device processes the data of the documents to be printed in the form of a plurality of scan lines. Each scan line includes a plurality of pels. For example, for a scan resolution of 2400 dots per inches (dpi) and a scan line length of 8.5 inches, the number of pels, also referred to as pel count, is 20,400. Each of the plurality of scan lines of the data is divided into one or more regions, where each region includes a predefined number of pels, for example, 64 pels.

In the electrophotographic device, first computation module 202 computes one or more total time-slices corresponding to one or more regions of the data. The total time-slices corresponding to a single region of the data include the time-slices to be inserted in the region and the time-slices corresponding to the plurality of pels of the region. The total time-slices in a region can be expressed in the form of the following equation:

$$\text{Total time-slices}=\text{Inserted slices}+\text{Base slices} \quad (1)$$

where 'inserted slices' are the time-slices to be inserted in the region of the data, and 'base slices' are the time-slices corresponding to the predefined number of pels in the region. For example, a region of 64 pels with 6 time-slices per pel includes 384 (64×6) base slices. The total time-slices in a region can therefore be expressed in the form of the following equation:

$$\text{Total time-slices}=\text{Inserted slices}+64*\text{Slices per pel} \quad (2)$$

The total time-slices in a region can also be defined as the number of time-slices required to ensure that at the end of a region, the laser beam is located 64 pels away from its start location.

The computation of the total time-slices is based on a first predefined criterion. In an embodiment of the invention, the first predefined criterion is based on one or more properties of the electrophotographic device, for example, laser beam velocity, speed of the mirror motor, pel size, and so forth. The computation of the total time-slices in a region, based on the first predefined criterion, is expressed using the following equation:

$$\text{Total time-slices}=\text{Region size}/(\text{Beam velocity}*\text{Mirror motor speed}*\text{Slice time}) \quad (3)$$

where 'region size' is measured in millimeters and is dependent on the size of a pel, 'beam velocity' refers to the laser beam velocity at the photoconductor drum and is expressed in mm/degree, 'mirror motor speed' refers to the speed of the motor that is spinning the polygon mirror and is expressed in Revolutions Per Minute (RPM), and 'slice time' refers to the period of the slice clock and is measured in seconds. Further, the pel size is dependent on the scan resolution. For example, for a scan resolution of 600 dpi, the pel size is 1/600 inches or 0.0016666 inches or 0.04233 mm; for a scan resolution of 1200 dpi, the pel size is 1/1200 inches or 0.00083333 inches or 0.02116 mm, and the like. Furthermore, the mirror motor speed is based on the speed of the print media and is translated into units of degrees per second. For example, a mirror motor spinning at 24375 RPM sweeps through 146250 degrees per second (24375 rev/min*(1 min/60 seconds)*360 degrees/rev).

In an embodiment of the invention, the pel size is measured in two directions, the scan direction and the process direction. The scan direction is expressed from the left end of the page to its right end, or vice-versa, whereas the process direction is from the top of the page to its bottom. In another embodiment of the invention, the pel size is expressed in two domains. The first domain is length where the pel has a specific length on the printed page, depending on the scan resolution. For example, for a scan resolution of 1200 dpi, the size of a pel is 1/1200 of an inch, and so forth. To attain this length, the pel must be described in the second domain, which is time. In the time domain, each pel is broken down into sub-units of time, known as time-slices or time increments.

First computation module 202 computes one or more time-slices in each of the plurality of pels. Each of the plurality of pels includes a plurality of time-slices, for example, six time-slices. First computation module 202 computes the time-slices in the plurality of pels, based on a second predefined criterion. In an embodiment of the invention, the second predefined criterion is based on one or more properties of the electrophotographic device, for example, the desired scan resolution, the desired process resolution, the slice clock frequency, and the scan efficiency of the LSU. The time-slices in a pel are computed using the following equations:

$$\text{Scans per second}=\text{Process speed}/60*(\text{Page length}+\text{Gap})*\text{Process resolution}$$

$$\text{Pel size}=1/\text{Scan resolution}*25.4$$

$$\text{Full scan line length}=\text{Scan line length}/(\text{Scan efficiency}/100)$$

$$\text{Pel time}=\text{Pel size}/(\text{Scans per second}*\text{Full scan line length})$$

$$\text{Slices per pel}=x$$

$$\text{Slice time}=\text{Pel time}/\text{Slices per pel}$$

$$\text{Slice clock frequency}=1/\text{Slice time}$$

where 'process speed' refers to the speed of imaging the document and is measured in Pages Per Minute (PPM), 'page length' is measured in inches, 'gap' refers to the inter-image gap and is measured in inches, 'process resolution' is measured in scans per inch, 'scan resolution' is measured in pels per inch, 'scan line length' is measured in inches, and 'scan efficiency' is expressed as a percentage of the polygon facet of the rotating polygon mirror that is used inside the printable region. The scan efficiency of a laser scanning unit is expressed as the ratio of the duration of time the beam is physically in the writing area of the photoconductor divided by the time it takes for the beam to traverse the entire beam path. For a rotating mirror scanning unit, the time taken by the beam to start on a new facet till the time the beam is directed to a useable location is lost. Similarly, the time taken from the last writing position to the start of a new facet is also lost. Scan efficiency is affected by optical design and primarily affected by the optical distance from the rotating polygon to the image plane. Slices-per-pel is the number of time-slices in a pel. The value of slices per pel is selected, so that the value of the slice clock frequency lies within a specified range.

First computation module 202 computes the base slices in a region, based on the computation of the time-slices in a pel. For example, if the value of time-slices in a pel is five, there will be 320 (64×5) base slices in the region. Further, based on the computation of base slices and the total time-slices corresponding to a region, the inserted slices corresponding to the region are computed according to equation (1). Thereafter, addition module 204 adds a plurality of random numbers to the one or more total time-slices.

It will be apparent to a person skilled in the art that irregular scan or scan anomalies can be introduced in electrophotographic devices due to polygon irregularities such as facet to facet run out and motor imbalance. For example, the location of a generated spot may move even with the mirror motor velocity constant and logic signals firing the laser fixed from the beam detection point. This motion in the generated spot position is referred to as scan jitter and process jitter. Scan jitter is in the scan direction and process jitter is in the process location. Matrix addition of random numbers introduces spot motion. If the matrix introduces spot motion at a regular time interval and the laser scanning unit has a high level of scan jitter which also occurs at the same regular time interval, then the interaction of these intervals or frequencies may occur at an objectionable level. Thus, random numbers are arranged in the form of a matrix of size N×N, where the value of N is chosen to be a non-multiple of the number of facets of the polygon mirror of the LSU. It will be evident to a person skilled in the art that the plurality of random numbers can be arranged in various forms, for example, an array and a matrix of different sizes.

The elements of the matrix are random numbers with small values, for example, the elements of the matrix may be between the range of +3 to −3. The elements are selected in such a way that the sum of the random numbers across each row of the matrix is zero. For example, the following matrix is an exemplary 7×7 matrix of random numbers, with each row summing to zero.

$$\begin{matrix} -1 & 0 & -1 & 0 & -1 & 0 & +3 \\ 0 & +1 & 0 & 0 & -1 & 0 & 0 \\ -1 & -1 & +1 & 0 & +1 & +1 & -1 \\ -1 & 0 & +1 & +1 & +1 & +1 & -3 \\ 0 & 0 & 0 & 0 & 0 & -1 & +1 \end{matrix}$$

-continued $$\begin{matrix} -1 & 0 & 0 & 0 & 0 & 0 & +1 \\ 0 & -1 & 0 & 0 & -1 & 0 & +2 \end{matrix}$$

The elements of the matrix are added to the total time-slices in a linear order, and only one element of the matrix is added to the total time-slices corresponding to a single region. For example, the first element of the matrix (the element at row 1 and column 1 of the matrix, which is −1) is added to the total time-slices of the first region of the first scan line. The second element, 0, (the element at row 1 and column 2 of the matrix) is added to the total time-slices of the second region of the first scan line, and so forth. Further, depending on the number of rows in the matrix, the elements of the matrix are added to the total time-slices of the regions of multiple scan lines. For example, if the matrix of random numbers includes seven rows, the first element of each row of the matrix is added to the total time-slices of the first region of the first seven scan lines of the data, and so forth. In an embodiment of the invention, the elements of the matrix are added to the inserted slices corresponding to the multiple regions of the data. Only one element of the matrix is added to the inserted slices corresponding to a particular region.

Second computation module 206 computes a plurality of scan insertion vectors. The scan insertion vectors are computed based on the addition of the plurality of random numbers to the total time-slices corresponding to the multiple regions of the data.

Each of the scan insertion vectors corresponds to a single scan line and includes a plurality of tokens, for example, 335 tokens in a single scan line, and each token corresponds to a specific region of the data. The token describes the insertion rate for a region of the data, i.e., the number of time-slices to be inserted in the region. Further, the token describes the insertion rate for 64 pels, corresponding to the region of the data, irrespective of the physical size of the pels in the region. For example, for a resolution of 2400 dpi in the scan direction, each pel is $1/2400^{th}$ of an inch or approximately 10 microns in size. Therefore, a token defines an insertion rate of 640 microns (64*10 microns). However, at 1200 dpi, the token defines an insertion rate of a 1.2 mm region.

Every token is made of nine bits that are divided into groups of three bits and six bits each. The three bits define a whole number of time-slices to be inserted in the region, and six bits define a fractional number of time-slices to be inserted in the region.

Memory module 208 stores the plurality of scan insertion vectors in a memory, for example, Dynamic Random Access Memory (DRAM), Non-Volatile Random Access Memory (NVRAM), and the like. There are 'N' vectors stored in the memory, with the value of N typically in the range of 10 to 30. Further, the number of scan insertion vectors stored in the memory, corresponding to a single page, is dependent on the page length. For example, an 1-inch-long page has 6600 (600 scans per inch*11 inches) scan insertion vectors stored in the memory.

In another embodiment of the invention, the number of scan insertion vectors stored in the memory is predefined, for example, 19. To avoid a multiple of any system parameter, for example, eight facets of the polygon mirror, the number of scan insertion vectors stored in the memory is 19. Further, the scan insertion vectors stored in the memory are not identical to each other, i.e., the memory stores 19 unique scan insertion vectors.

Slice-insertion module 210 inserts the one or more time-slices in the one or more regions of the data. The time-slices are inserted, based on the plurality of tokens. Since each token corresponds to a particular region of the data, therefore, one or more time-slices are inserted in the region, based on the token corresponding to the particular region. The time-slices are inserted between two consecutive pels in the region. Further, the time-slices are inserted in the region in a predefined order, based on the plurality of random numbers. Since the plurality of random numbers added to different regions of each of the multiple scan lines vary with each scan line of the data, the time-slices inserted in the regions of each of the scan lines also vary. Therefore, the time-slices are inserted in the data in a random order, with the insertion pattern varying across different scan lines and also within a single scan line. The insertion of the time-slices in the data corrects the linearity error, since the laser beam velocity and the data rate synchronize with the insertion of additional time-slices in the data.

Figure 3:
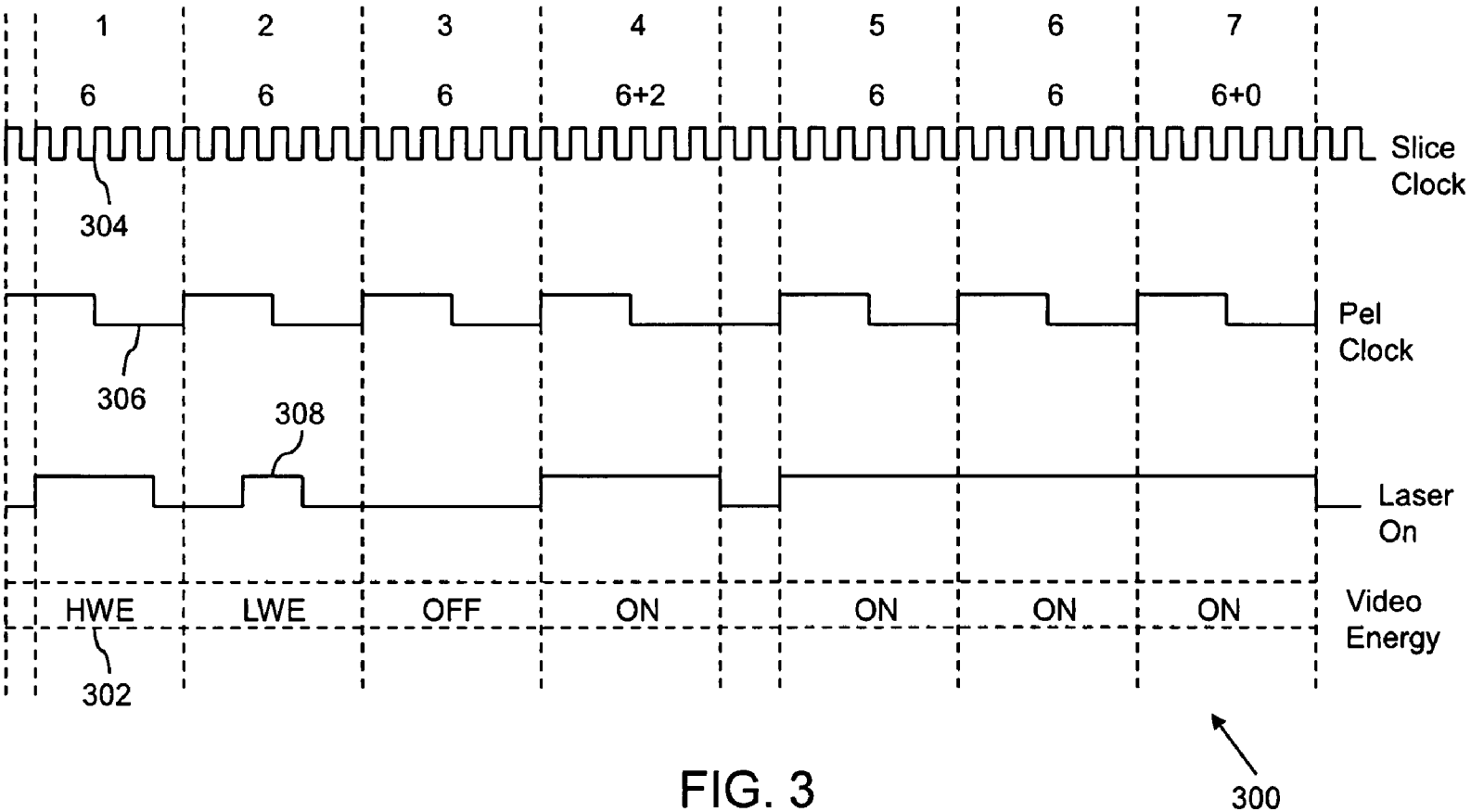
FIG. 3 is a signal-timing diagram illustrating the insertion of additional time-slices in the data, in accordance with an embodiment of the invention.

FIG. 3 is a signal-timing diagram 300 illustrating the insertion of additional time-slices in the data, in accordance with an embodiment of the invention. Signal-timing diagram 300 includes a first signal 302, a second signal 304, a third signal 306, and a fourth signal 308. Signal-timing diagram 300 has been described in detail in conjunction with the U.S. patent application Ser. No. 10/808,130, titled "Systems For Performing Laser Beam Linearity Correction And Algorithms And Methods For Generating Linearity Correction Tables From Data Stored In An Optical Scanner" assigned to the same assignee, the contents of which are incorporated by reference herein.

The documents processed by the electrophotographic device contain data, which is stored in the memory in the form of a bitmap, also referred to as bitmap data. The bitmap data includes a plurality of pixels (or picture elements). First signal 302, also referred to as video signal, is an encoded signal derived from the bitmap data read from the memory. First signal 302 is schematically represented in signal-timing diagram 300 using labels, such as OFF, LWE, HWE, and ON. Each pixel of the bitmap data is encoded into a plurality of time-slices, which collectively defines a corresponding pel along the associated scan line. If the pixel of the bitmap data is in an 'on' state, i.e., the pixel has a value of one, each time-slice defining the pel corresponding to the pixel of the bitmap data is also in an 'on' state, i.e., each time-slice is assigned the value of one. If the pixel of the bitmap data is in an 'off' state, i.e., the pixel has the value of zero, each time-slice defining a pel corresponding to that pixel of the bitmap data is also in an 'off' state, i.e., each time-slice has the value of zero.

In another embodiment of the invention, each time-slice in a pel corresponding to an associated pixel of the bitmap data can be individually turned 'on' or 'off' state. Therefore, each pel can be assigned a 'weight' in the scan line written by the laser beam. For example, each pixel of the bitmap data is encoded into an m-slice video signal that encodes p-possible weights for an associated pixel of the bitmap data. In the exemplary embodiment of FIG. 3, the values of m and p are six and four, respectively. Therefore, each bitmap pixel is encoded as a six-slice signal having one of the four possible weights. It will be evident to a person skilled in the art that various combinations of the values of m and p are possible. An exemplary six-slice encoding comprises the sequence "111111" for an "ON" pixel at full weight, and the sequence "011110" for an "ON" pixel at a High Weight Energy (HWE). The sequence "001100" encodes an "ON" pixel at a Low Weight Energy (LWE), and the sequence "000000" encodes an "OFF" pixel. First signal 302 is designated by its corresponding weight, for example, ON, HWE, LWE, or OFF in FIG. 3.

Second signal 304, hereinafter referred to as a slice clock 304, is a first clocking signal. Slice clock 304 is a fixed frequency clock that defines the duration of a time-slice, and therefore defines the duration of a pel. In other words, when a laser is instructed to write a pixel of the bitmap data, the laser writes to the photoconductor drum, a corresponding sequence of m laser pulses, where each pulse is triggered by the successive active edge of slice clock 304. Further, third signal 306, hereinafter referred to as pel clock 306, is a second clocking signal. A video processor of the electrophotographic device uses pel clock 306 to initiate the serial transmission of the next m-slice sequence to the laser system. The video processor uses first signal 302, slice clock 304, and pel clock 306 to derive fourth signal 308, hereinafter referred to as laser output 308, which is communicated to a printhead of the electrophotographic device.

The duration of each time-slice is controlled by the fixed-frequency slice clock 304. Pel clock 306 is used to control spacing between the pels, i.e., the timing of each written pel (or an m-slice sequence) is communicated to the laser system. The term 'written Pel', as used herein, encompasses both on and off pels, and therefore includes, for example, any one of a full ON pel, an HWE pel, an LWE pel, or an OFF pel. Therefore, the placement of each pel along the scan line is controlled, and also the duration of the laser being in an 'on' state for each pel along the scan line is independent of pel clock 306. For illustrative purposes, signal-timing diagram 300 illustrates a sequence of seven pels written by a laser of the laser system. Written pel 1 has HWE, written pel 2 has LWE, written pel 3 is off, and written pels 4 to 7 are all 'on' pels.

In the embodiment illustrated in FIG. 3, the active edge of slice clock 304 can occur either on the low-to-high edge or the high-to-low edge of pel clock 306. Therefore, slice clock 304 is a dual-edge clock. It will be evident to a person skilled in the art that the use of dual-edged clocks is optional. However, the dual-edge slice clock 304 provides great flexibility to the video processor while preparing laser output 308. For example, the video processor justifies the 'on' laser pulses to the center of a given m-slice sequence of a pel. In the six-slice sequence of pel 1 (HWE pulse 011110), the laser signal is 'on' for three half time-slices, hereinafter referred to as half-slices, into the six-slice sequence, as noted by laser output 308 going high on the third half pulse of slice clock 304. Laser output 308 is left turned 'on' for the next six half-slices, and 'off' for three half-slices. It will be evident to a person skilled in the art that the period in which laser signal 308 is 'on' for any given m-slice pel can alternatively be left justified, right justified, or otherwise distributed across the m-slices. Further, each weight can have different durations of 'on' and 'off' laser signals.

Linearity error-correction system 200 corrects the linearity error by nudging the selected written pels to divide the written pels evenly across the scan line. The written pels are nudged by adding one or more additional time-slices (or slice clock pulses) between the consecutive active edges of pel clock 306. For example, the spacing between each active edge of pel clock 306 is six slice clock pulses, i.e., each pel clock pulse includes six slice clock pulses. However, two additional slice clock pulses are added between the active edges of pel clock pulses 4 and 5, so that the pel clock pulse corresponding to written pel 4 has a period of eight slice clock pulses instead of six. Further, the additional time-slices inserted in pel clock pulses are always turned off, i.e., the time-slices have the value of zero, and are therefore also referred to as 'off slices'.

Figure 4B:
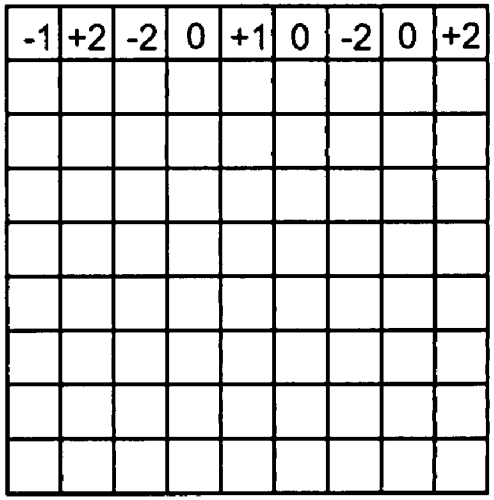
FIG. 4*b* illustrates the plurality of random numbers stored in the form of a matrix and FIG. 4*c* illustrates scan insertion vectors 404 stored in the memory.
Figure 4A:
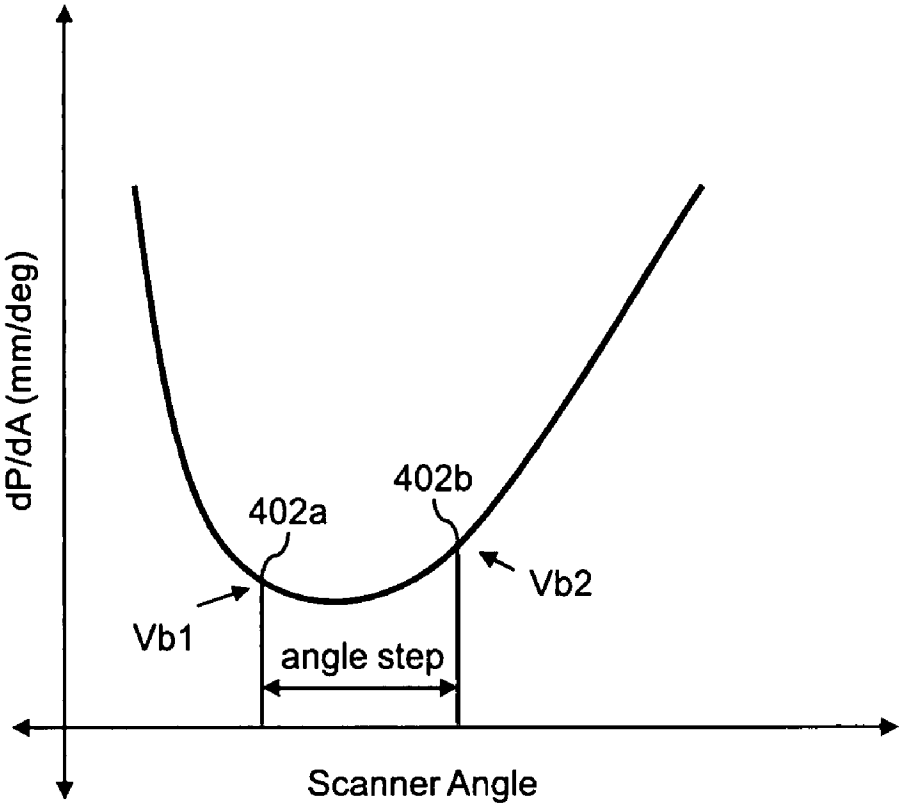
FIG. 4*a* graphically depicts the computation of scan insertion vectors 404, in accordance with an embodiment of the invention.
Figure 4C:
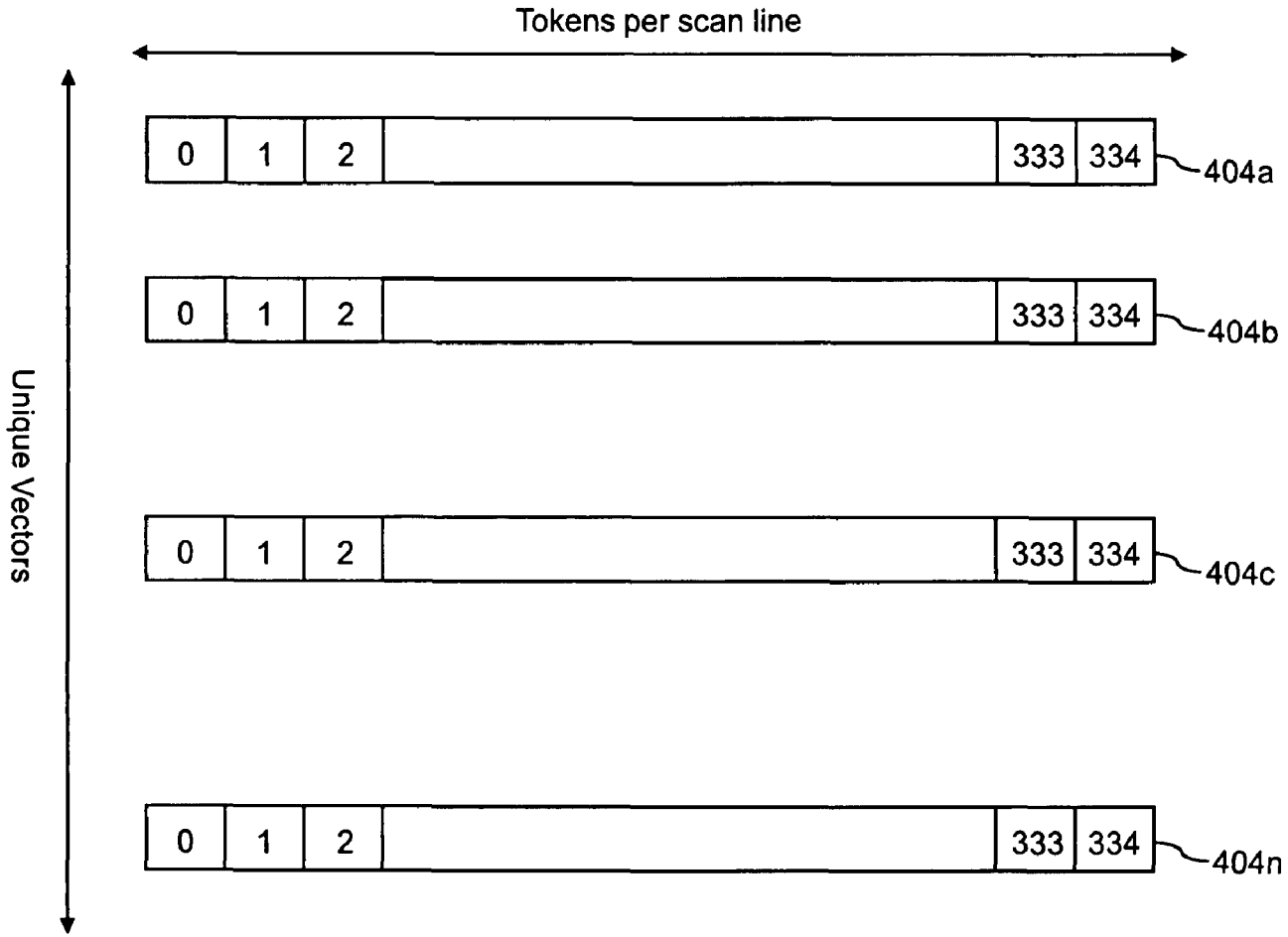

FIG. 4*a* graphically depicts the computation of scan insertion vectors 404, in accordance with an embodiment of the invention. FIG. 4*b* illustrates the plurality of random numbers stored in the form of a matrix. FIG. 4*c* illustrates scan insertion vectors 404 stored in the memory.

The computation of scan insertion vectors 404 is based on computing the derivative of the scan position with respect to the change in the scanner angle. In an embodiment of the invention, various algorithms, such as the Newton Forward Difference algorithm, are implemented to compute the derivative of the scan position (also referred to as beam position) with respect to the change in the scanner angle.

The computation of the derivative of the scan position with respect to the change in the scanner angle is represented graphically in FIG. 4*a*. FIG. 4*a* includes a graph 400 including multiple reflection points 402 such as reflection point 402*a* and reflection point 402*b*. Reflection points 402*a* and 402*b* represent two distinct values of dP/dA that are hereinafter referred to as Vb1 and Vb2 respectively. dP/dA refers to the change in the scan position with respect to the change in the scanner angle. Further, reflection points 402*a* and 402*b* represent two distinct values of scanner angle that are hereinafter referred to as a1 and a2 respectively. The change in the scanner angle with respect to the two reflection points 402*b* and 402*a*, i.e. the difference between a2 and a1, is referred to as angle step.

Further, the computation of the derivative of the scan position with respect to the change in the scanner angle yields the distance covered by a token in a region, i.e. the distance for which the token describes the insertion rate in a region. For example, for a scan resolution of 2400 dpi, each pel is $1/2400^{th}$ of an inch or approximately 10 microns and a token describes the insertion rate for 640 microns (64 pels*10 microns per pel) of the region. Thus, the token covers 640 microns in the region. The distance covered by the token in the region can be expressed using the following equations:

$$\text{Distance}=\int Vb*da$$

where 'Vb' is the change in the value of dP/dA i.e. Vb=Vb1−Vb2 and 'da' is the change in the scanner angle. Further, for small change in dP/dA and/or scanner angle, i.e., for lower values of Vb and/or lower values of da, the distance covered by the token in the region may be expressed using the following equation:

$$\text{Distance}=Vb*\text{angle step}$$

Furthermore, for higher changes in dP/dA and/or scanner angle, i.e., for high values of Vb and/or high value of da, the distance covered by the token in the region can be expressed using the following equation:

$$\text{Distance}=[(Vb1+Vb2)/2]*\text{angle step}$$

Further, as explained in conjunction with FIG. 2, the computation of scan insertion vectors 404 is based on the addition of the plurality of random numbers to the total time-slices corresponding to the region. The computation of the total time-slices corresponding to a region can be expressed using the following equations:

$$\text{Total time-slices}=Kd/(dP/dA) \quad (4)$$

$$Kd=Ks/(Ts*\text{omega}) \quad (5)$$

where 'Kd' is a system constant, 'Ks' is the step distance per token or 64*pel size and is expressed in micrometer (um) or microns (μ), 'Ts' is the time per slice, also referred to as slice period and 'omega' is the change in polygon mirror position per second and is expressed in degrees per second. For example, at scan resolution of 2400 dpi and mirror motor speed of 24375 RPM, Ts is $1.67e^{-9}$, Ks is 677.3333328 um and Kd is 2778803.417.

Furthermore, during the computation of scan insertion vectors 404, linearity error correction system 200 adds a plurality of random numbers to the total time-slices. The random numbers are added to the total time-slices in order to insert the time-slices randomly in the multiple regions. The random numbers thereby added, are small values and are represented in the form of a matrix as illustrated in conjunction with FIG. 2. Further, the matrix is stored in the memory as illustrated in FIG. 4*b*. Only one element of the matrix is added to the total time-slices corresponding to a particular region. Similarly, the elements of the matrix are added to the total time-slices corresponding to each of the regions with the addition being performed in a linear order as explained in conjunction with FIG. 2.

Subsequently, the addition of the plurality of random numbers to the total time-slices generates a plurality of scan insertion vectors 404. Each of scan insertion vectors 404 describes a single scan line. Further, each of scan insertion vectors 404 includes a plurality of tokens for example, 335 tokens. As explained in conjunction with FIG. 2, each token corresponds to a single region of a scan line. The token describes the insertion rate for a particular region. Similarly, a group of tokens in a scan line describe the insertion rate for all the regions of the scan line. Further, each of the scan insertion vectors 404 is unique as illustrated in FIG. 4*c*. FIG. 4*c* illustrates the number of tokens per scan line and the number of unique scan insertion vectors 404 such as a scan insertion vector 404*a*, a scan insertion vector 404*b*, a scan insertion vector 404*c*, a scan insertion vector 404*n* and so forth. The unique scan insertion vectors 404 are stored in the memory. The number of unique scan insertion vectors 404 to be stored in the memory is predefined, for example, 19 scan insertion vectors.

Figure 5:
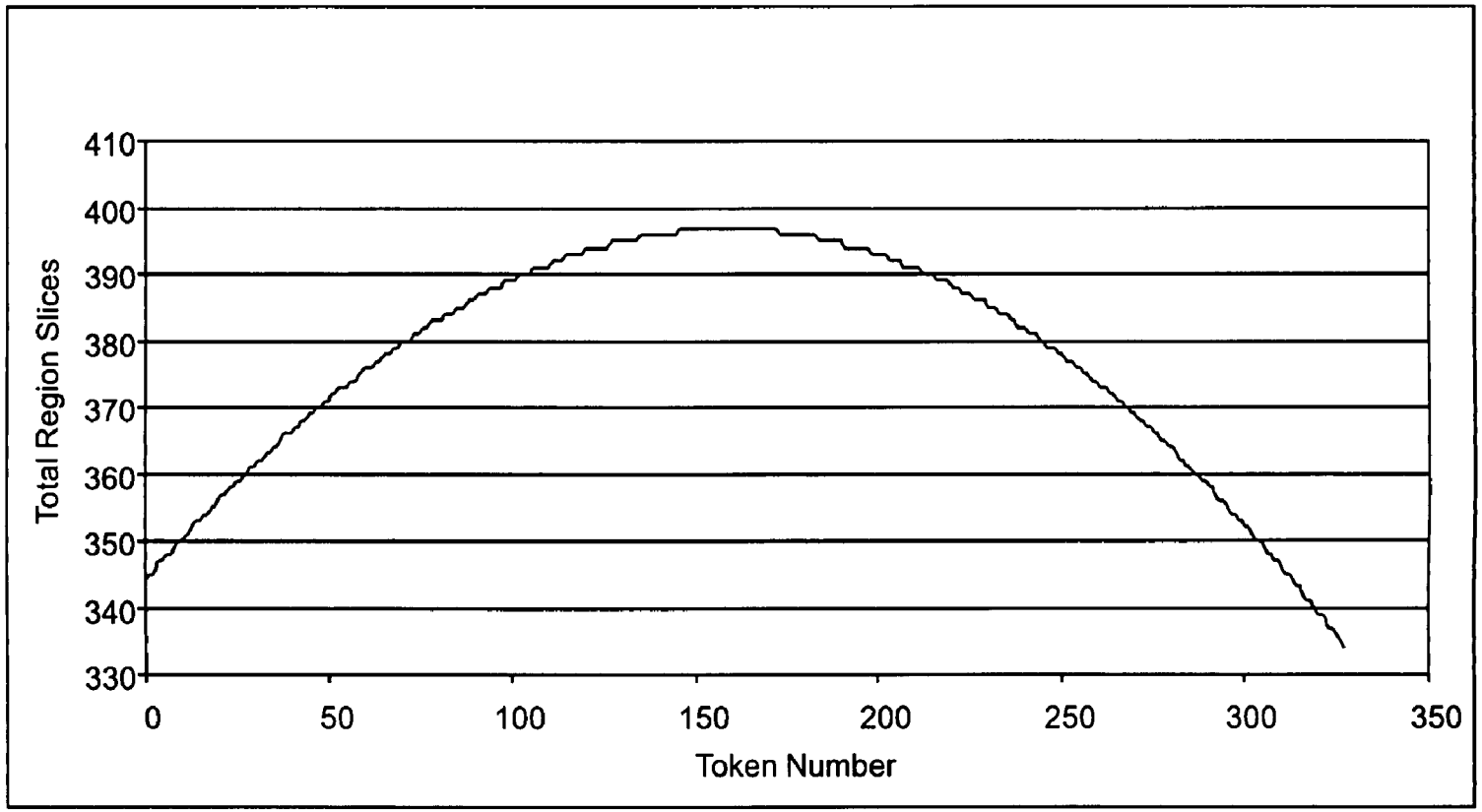
FIG. 5 graphically depicts total time-slices in multiple regions of the data, in accordance with an embodiment of the invention.

FIG. 5 graphically depicts total time-slices in multiple regions of the data, in accordance with an embodiment of the invention. FIG. 5 includes a graph 500 illustrating the total time-slices corresponding to the multiple regions of a single scan line of the data. Each point on graph 500 is the number of the total time-slices that must be present in the particular region. Each region of the scan line is represented by a corresponding token. Thus, graph 500 represents the total time-slices corresponding to the token values representing the multiple regions of a single scan line of the data. For example, graph 500 represents the total time-slices corresponding to 335 tokens of a scan insertion vector representing a scan line. Further, the total time-slices corresponding to the regions of the data are stored in the form of a one-dimensional array. The following one-dimensional array illustrates the total time-slices corresponding to the first six tokens of a scan insertion vector:

| | Token Number | | | | | |
|---|---|---|---|---|---|---|
| | 0 | 1 | 2 | 3 | 4 | 5 |
| Total Time-slices | 327 | 328 | 328 | 329 | 329 | 330 |

Further, as illustrated in FIG. 5 the total time-slices corresponding to the tokens of a scan line of the data increase toward the centre of the scan line as compared to the edges of the scan line. Since, the speed of the laser beam on the edges of the photoconductor drum is greater in comparison to the speed at the centre, the number of time-slices inserted in the regions at the center of the document is greater than the number of time-slices inserted in the regions at the edges.

Figure 6:
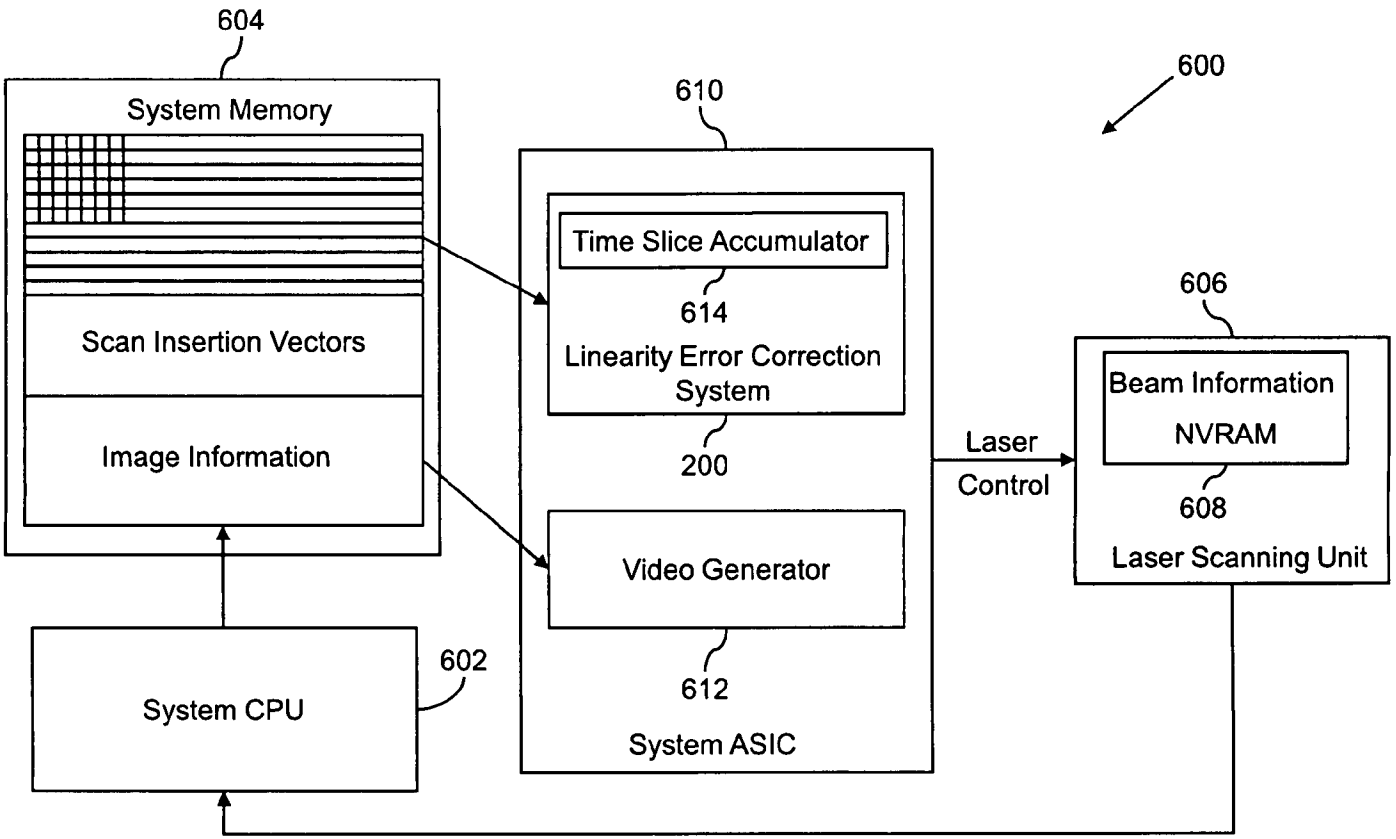
FIG. 6 is a block diagram illustrating a data processing system of the electrophotographic device, in accordance with an embodiment of the invention.

FIG. 6 is a block diagram illustrating a data processing system 600 of the electrophotographic device, in accordance with an embodiment of the invention. Data processing system 600 includes a system Central Processing Unit 602, hereinafter referred to as system CPU 602, a system memory 604, a Laser Scanning Unit 606, hereinafter referred to as LSU 606, and a system Application Specific Integrated Circuit 610, hereinafter referred to as system ASIC 610. LSU 606 includes a beam information NVRAM 608. System ASIC 610 includes linearity error correction system 200 and a video generator 612. Linearity error correction system 200 includes a time-slice accumulator 614.

Data processing system 600 is used by the electrophotographic device for processing documents provided by the user and for correcting the linearity error of the electrophotographic device. System CPU 602 receives the documents from the user and renders the data (or image) in the documents into image information (also referred to as image tiles). In an embodiment of the invention, system CPU 602 when implemented in a colored electrophotographic device produces four types of image information corresponding to the four color planes, i.e., cyan, magenta, yellow and black. The image information is stored in system memory 604. Further, system CPU 602 reads characterization information or beam information from LSU 606. The characterization information primarily defines the motion of the laser beam across the photoconductor drum and includes properties of the electrophotographic device, for example, laser beam velocity, mirror motor speed, scan resolution and so forth. LSU 606 includes NVRAM 608 for storing the characterization information. System CPU 602 generates a plurality of scan insertion vectors 404 using the characterization information, which are then stored in system memory 604. Scan insertion vectors 404 stored in system memory 604 are unique with respect to each other.

Video generator 612, in system ASIC 610 uses the image information stored in system memory 604 for image generation. In an embodiment of the invention, system ASIC 610 when implemented in a colored electrophotographic device includes four video generators 612, one for each of the cyan, magenta, yellow and black image planes.

Thereafter, scan insertion vectors 404 are accessed by system ASIC 610 while image is being generated. Linearity error correction system 200, in system ASIC 610 uses scan insertion vectors 404 for correcting the linearity error of the electrophotographic device. As explained in conjunction with FIG. 2, linearity error correction system 200 uses scan insertion vectors 404 for inserting time-slices in the image data. Each of scan insertion vectors 404 corresponds to a single scan line of the data and is used for inserting time-slices in the particular scan line. In an embodiment of the invention, linearity error correction system 200 uses only the predefined unique scan insertion vectors 404 for inserting time-slices in the data.

In an embodiment of the invention if the first token for each of scan insertion vectors 404 is, for example 24, then additional time-slices are inserted in 24 pels in the 64 pel region. Further, the data being processed is such that 24 pels are in the 'on' state and evenly spaced. Based on the position of 24 pels in the region of the data, the 24 pels occur at the points of insertion of additional time-slices in the region. This effect of lining-up of the time-slices is referred to as 'beating' since two frequencies, the insertion frequency and the image data frequency, are involved. It is desirable that the possibility of beating of the two frequencies is minimized. Therefore, by inserting the time-slices in a random order, the frequency beat issue is reduced.

During the construction of scan insertion vectors 404, linearity error correction system 200 adds a random number to each of the tokens of scan insertion vectors 404. Each token corresponding to a region includes a whole number of time-slices to be inserted in the region and a fractional number of time-slices to be inserted in the region. The whole number of time-slices is inserted in the region by linearity error-correction system 200. In an embodiment of the invention, linearity error-correction system 200 inserts time-slices in between two pels in the region. Furthermore, linearity error-correction system 200 includes time-slice accumulator 614 for accumulating the fractional time-slices to be inserted in the data. Time-slice accumulator 614 accumulates the fractional number of time-slices from each of the tokens. When the number of time-slices in time-slice accumulator 614 exceeds or is equivalent to a predefined value, time-slice accumulator 614 signals linearity error correction system 200 to insert one or more time-slices in the region of the data. The insertion of the time-slices in the data corrects the linearity error of the electrophotographic device.

Figure 7:
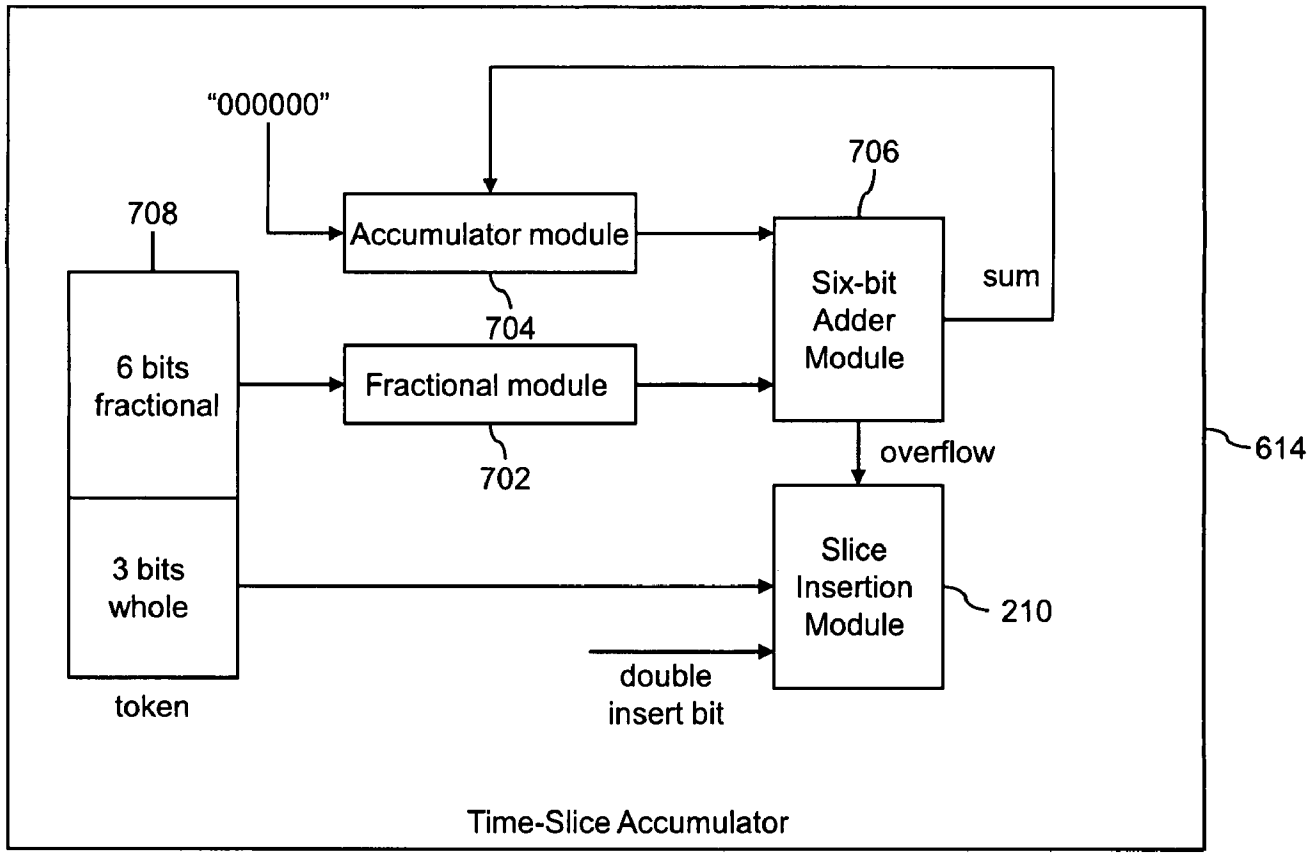
FIG. 7 is a block diagram illustrating a time-slice accumulator of the data-processing system, in accordance with an embodiment of the invention.

FIG. 7 is a block diagram illustrating time-slice accumulator 614 of data processing system 600, in accordance with an embodiment of the invention. Time-slice accumulator 614 includes slice insertion module 210, a fractional module 702, an accumulator module 704, and a six-bit adder module 706.

As explained in conjunction with FIG. 6, time-slice accumulator 614 accumulates the fractional number of time-slices from each of the multiple tokens. Each token, such as a token 708, is made up of nine bits that are divided into groups of three bits and six bits. The three bits define the whole number of time-slices to be inserted in the data and the six bits define the fractional number of time-slices to be inserted in the data. The whole number of time-slices is inserted in the regions by slice-insertion module 210.

Further, the six bits of token 708 representing the fractional number of time-slices are accessed by fractional module 702 and forwarded to six-bit adder module 706. Furthermore, six-bit adder module 706 receives a second input from accumulator module 704. Accumulator module 704 has an initial value of zero. Accumulator module 704 stores the value in the form of six bits, for example, 000000 and forwards the value to six-bit adder module 706. Six-bit adder module 706 generates a sum of the values obtained from accumulator module 704 and fractional module 702. The sum, thereby generated is stored in accumulator module 704.

Further, six-bit adder module 706 performs a check on the value of the sum to determine whether the value of the sum exceeds or is equal to a predefined value or a threshold value, for example, 111111. If the value of the sum does not exceed the predefined value, the value of the sum is stored in accumulator module 704. However, if the value of the sum exceeds the predefined value, six-bit adder module 706 overflows and slice insertion module 210 inserts a time-slice in the region of the data in addition to the whole number of inserted time-slices defined by 3 bits of token 708. In another embodiment of the invention, slice insertion module 210 inserts two time-slices in the region of the data when accumulator module 704 overflows. Two time-slices are inserted in the data when a double insert bit in scan insertion vector 404 is set i.e. the double insert bit has a value of one. If six-bit adder module 706 overflows an insertion event is triggered.

Figure 8A:
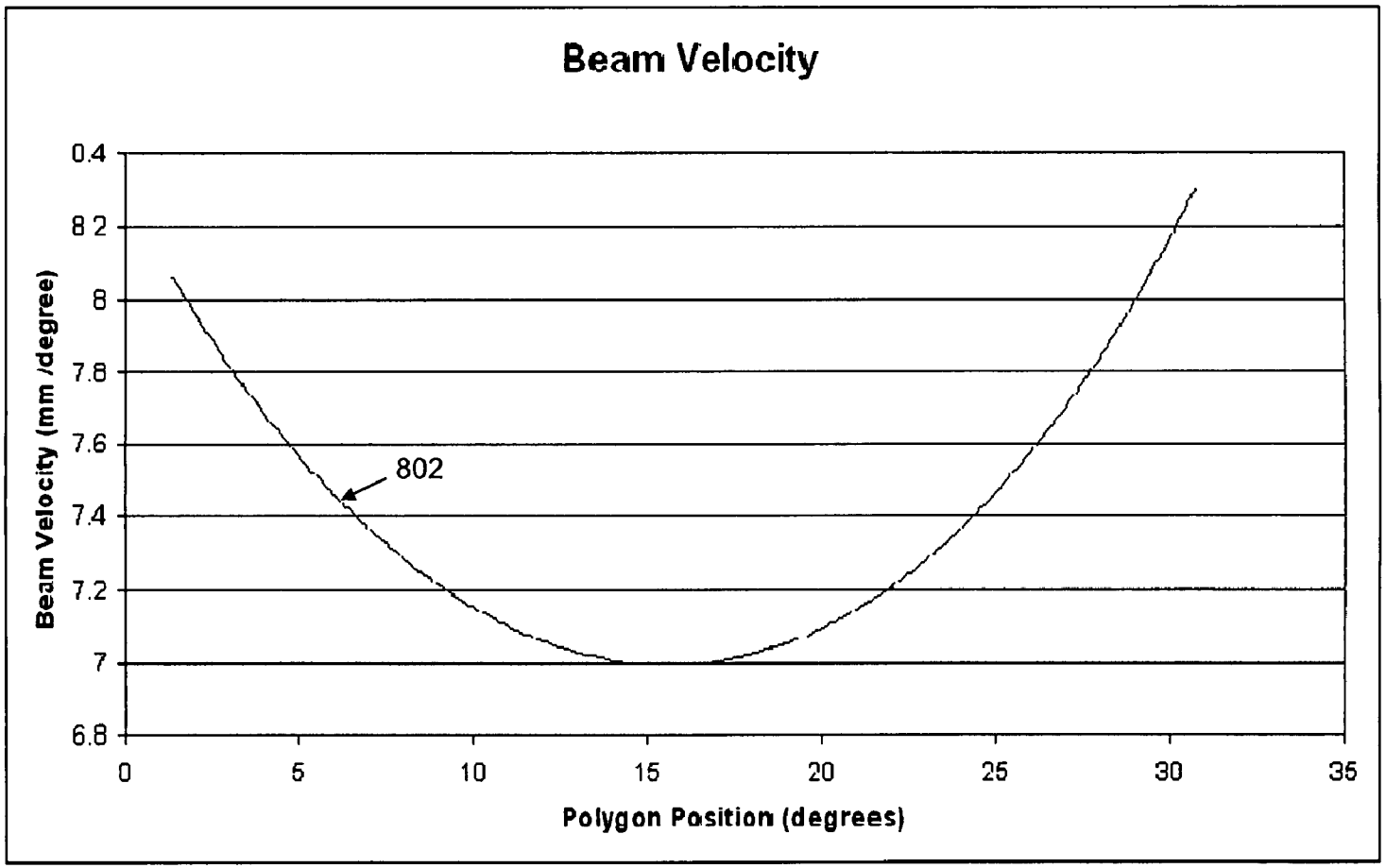
FIG. 8*a* is a graphical representation of beam velocity with respect to polygon positions during a scan motion and FIG. 8*b* is a graphical representation of additional inserted time-slices with respect to a plurality of tokens, in accordance with an exemplary embodiment of the invention.
Figure 8B:
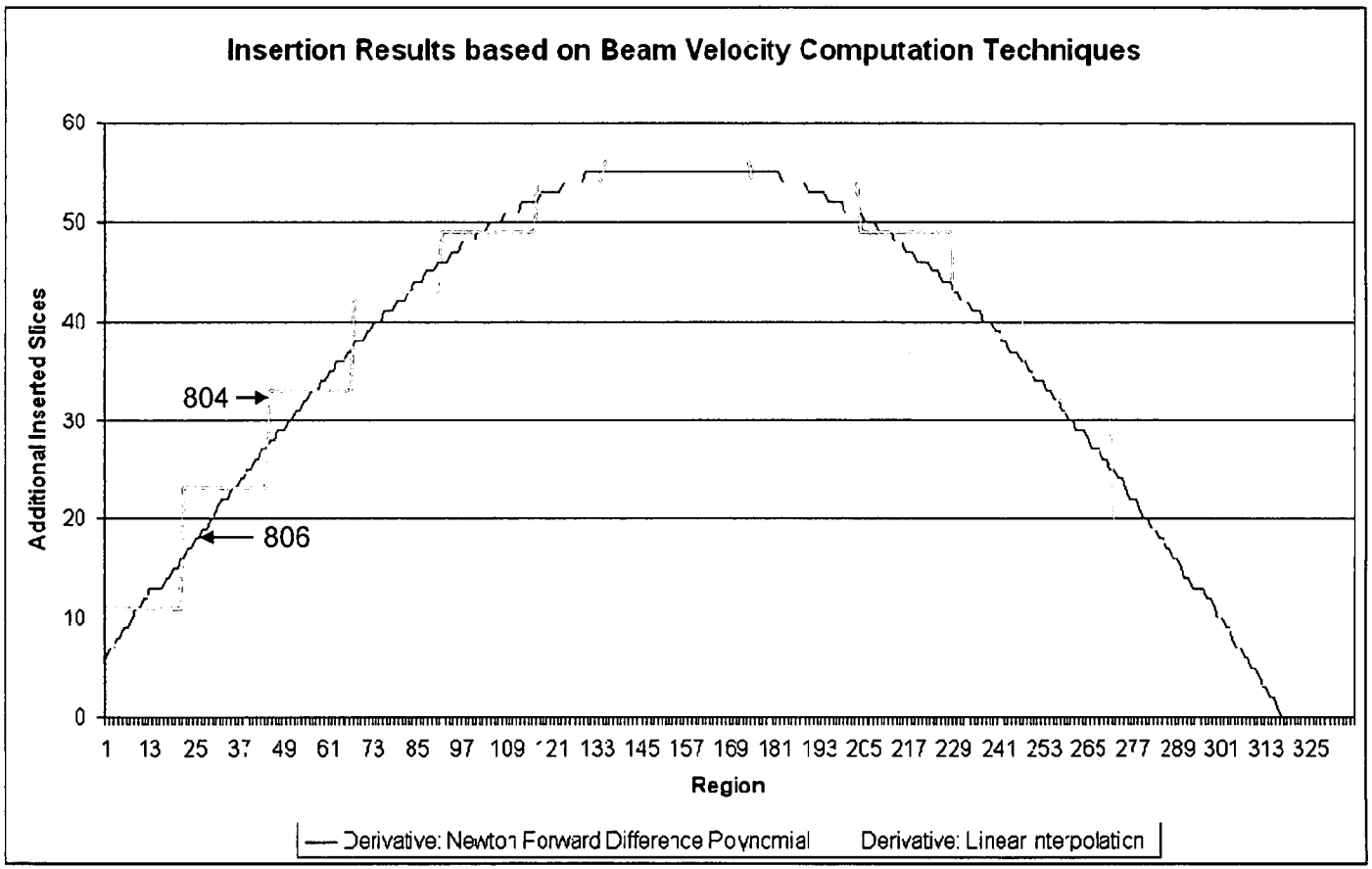

FIG. 8*a* is a graphical representation of beam velocity with respect to polygon positions during a scan motion and FIG. 8*b* is a graphical representation of additional inserted time-slices with respect to a plurality of tokens, in accordance with an exemplary embodiment of the invention. Curve 802 depicts the beam velocity in mm/degree and illustrates that the velocity of the beam is higher at the edges of a document being scanned as compared to the centre of the document. Thus, for a system that has a high level of beam velocity variation, it becomes important to compute an insertion profile that matches the beam velocity. If the beam velocity is measured with too few samples, the scan insertion vector takes on the form of stair steps i.e., the same insertion value is used for a relatively long part of the scan, illustrated by curve 804 in FIG. 8*b*. Since the insertion vector interacts with printed data, this can cause wide light and dark banding on the page. Along with dark banding, excessive linearity error results within a local region on the page. FIGS. 8*a* and 8*b* illustrate this effect. Curve 804 illustrates the data generated using 15 sample points along the beam velocity curve. Curve 806 illustrates the data generated by using Newton Forward Difference Polynomial which eliminates the stair step effect.

Figure 9:
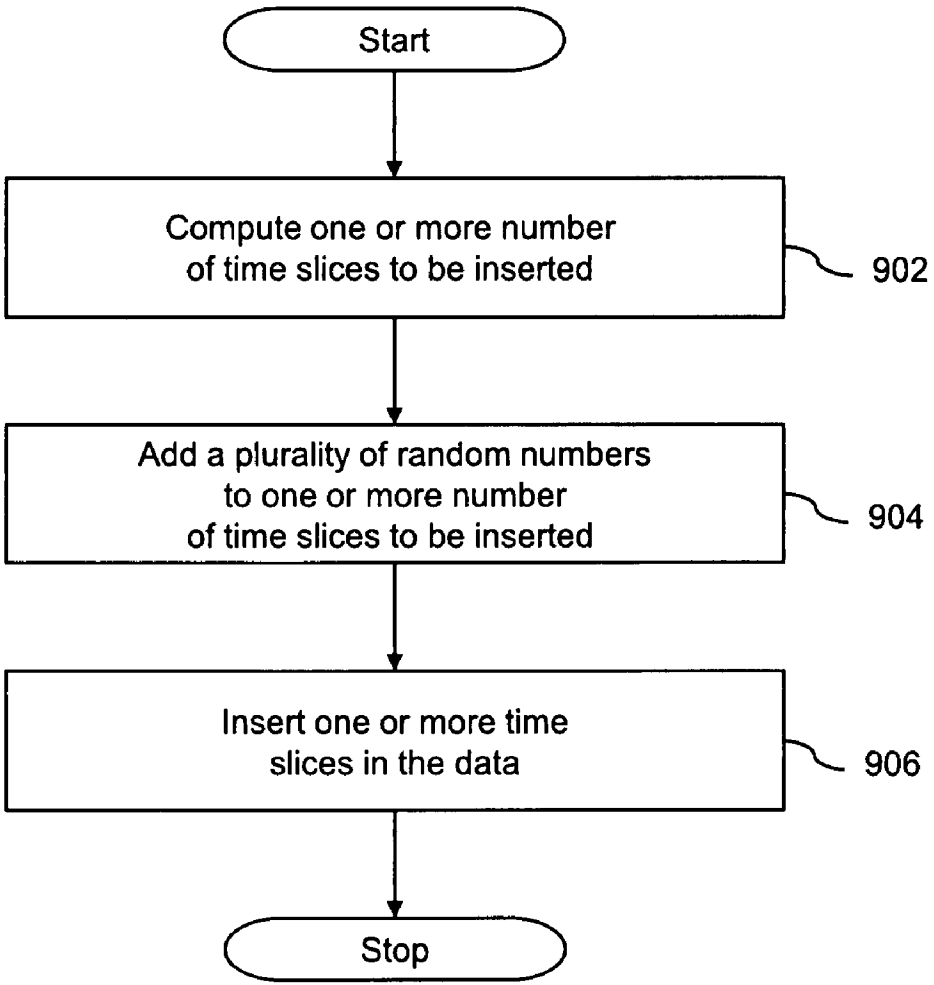
FIG. 9 is a flowchart illustrating a method for correcting the linearity error of the electrophotographic device, in accordance with an embodiment of the invention.

FIG. 9 is a flowchart illustrating a method for correcting the linearity error of the electrophotographic device, in accordance with an embodiment of the invention. The electrophotographic device using a reduced set of lenses generates a high linearity error in the output produced. The electrophotographic device processes one or more documents containing data. The data is divided into a plurality of scan lines, each scan line including a plurality of pels. Further, each of the scan lines is divided into a plurality of regions, each region including a predefined number of pels, for example, 64 pels.

At 902, one or more time-slices are computed based on one or more properties of the electrophotographic device, for example, scan resolution, laser beam velocity, mirror motor speed and so forth. The time-slices correspond to the multiple regions of the data. At 904, a plurality of random numbers are added to the one or more time-slices computed at 902. The random numbers are stored in the form of a matrix, as explained in conjunction with FIG. 2. The elements of the matrix are added to the multiple time-slices with only one element of the matrix being added to the time-slices corresponding to a single region of the data. The addition of the elements of the matrix is performed in a linear order across all scan lines of the data as explained in conjunction with FIG. 2.

Thereafter, at 906, one or more time-slices are inserted in the data. The time-slices are inserted in multiple regions of the data. In an embodiment of the invention, the time-slices are inserted in between two pels of a region of the data. Further, the time-slices are inserted in each of the plurality of scan lines of the data. The time-slices are inserted in a predefined order based on the addition performed at 904. As explained in conjunction with FIG. 2, the addition of the plurality of random numbers to the time-slices varies across different scan lines of the data and also within a single scan line of the data. Therefore, the time-slices are inserted in the data in a random order and each scan line of the data has a unique order of insertion. The insertion of the time-slices in the data, in an order varying across each of the scan lines of the data, corrects the high linearity error of the electrophotographic device with a reduced number of lenses.

Figure 10:
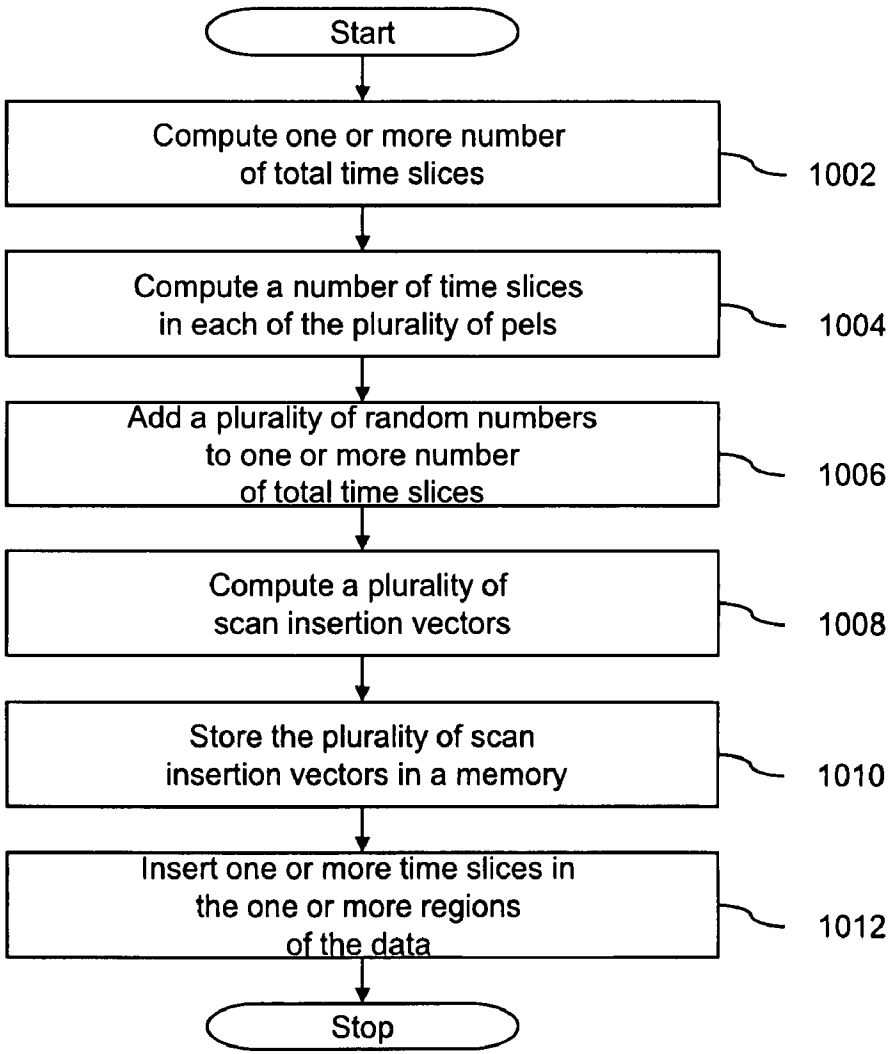
FIG. 10 is a flowchart illustrating a method for correcting the linearity error of the electrophotographic device, in accordance with another embodiment of the invention.

FIG. 10 is a flowchart illustrating a method for correcting the linearity error of the electrophotographic device, in accordance with another embodiment of the invention. At 1002, one or more total time-slices corresponding to the multiple regions of the data are computed. The total time-slices corresponding to a region of the data include the time-slices to be inserted in the region and the time-slices corresponding to the plurality of pels of the region of the data, as explained in conjunction with equation (1). The total time-slices are computed based on a first predefined criterion as explained in conjunction with FIG. 2. The first predefined criterion is based on one or more properties of the electrophotographic device, for example, scanner angle, laser beam velocity and so forth.

Further, at 1004, the time-slices in each of the plurality of pels are computed. The computation of the time-slices in the plurality of pels is based on a second predefined criterion as explained in conjunction with FIG. 2. The second predefined criterion is based on the one or more properties of the electrophotographic device, for example, scan resolution, mirror motor speed and so forth.

Thereafter, at 1006, a plurality of random numbers are added to the total time-slices corresponding to the plurality of regions of the data. In an embodiment of the invention, the plurality of random numbers are added to the one or more time-slices to be inserted in the multiple regions of the data. The plurality of random numbers are stored in the form of a matrix as explained in conjunction with FIG. 2. The elements of the matrix are added to the multiple time-slices to be inserted in the data with only one element of the matrix being added to the time-slices to be inserted in a single region of the data. The addition of the elements of the matrix is performed in a linear order across al the scan lines of the data as explained in conjunction with FIG. 2.

Further, at 1008, a plurality of scan insertion vectors 404 are computed based on the addition of the plurality of random numbers to the total time-slices of the regions of the data. Each of the plurality of scan insertion vectors 404 corresponds to a single scan line of the data and includes a plurality of tokens. Each of the tokens corresponds to a particular region of the data and describes the number of time-slices to be inserted in the particular region of the data. The computation of scan insertion vectors 404 is explained in conjunction with FIG. 4*a*, FIG. 4*b* and FIG. 4*c*.

Furthermore, at 1010, each of scan insertion vectors 404 are stored in the memory, for example, DRAM and NVRAM. Scan insertion vectors 404 are unique with respect to each other and are stored and accessed from the memory before the scanning of the data begins. Further, in order to minimize the use of the memory for computing scan insertion vectors 404, a predefined number of unique scan insertion vectors 404, for example, 19 are stored in the memory.

Subsequently, at 1012, one or more time-slices are inserted in the regions of the data based on the plurality of tokens of scan insertion vectors 404. Each token corresponding to a region describes the number of time-slices to be inserted in the particular region. In an embodiment of the invention, the time-slices are inserted in between two pels of a region of the data. Further, the time-slices are inserted in the regions based on a predefined order. The predefined order of insertion is based on the plurality of random numbers added to the total time-slices. As explained in conjunction with FIG. 2, the addition of the plurality of random numbers to the time-slices varies across different scan lines of the data and also within a single scan line of the data. Therefore, the time-slices are inserted in the data in a random order and each scan line of the data has a unique insertion order. The insertion of the time-slices in the data, in a unique order varying across each of the scan lines of the data, corrects the high linearity error of the electrophotographic device with a reduced number of lenses.

The method and system described above correct the linearity error of the electrophotographic device by inserting additional time-slices in the data processed by the electrophotographic device. Further, the time-slices are inserted in a unique order varying across each scan line and also within a single scan line, which thereby minimizes the print artifacts. Therefore, the method and system correct the linearity error without sacrificing the print quality. Moreover, the method and system is used by the electrophotographic device with a reduced number of lenses and therefore, minimizes the cost of the electrophotographic device.

The linearity error correction system for correcting the linearity error of the electrophotographic device, as described in the present invention or any of its components, may be embodied in the form of a computer readable program code for a computer system. Typical examples of a computer system includes a general-purpose computer, a programmed microprocessor, a micro-controller, a peripheral integrated circuit element, and other devices or arrangements of devices that are capable of implementing the steps that constitute the method of the present invention.

The computer system comprises a computer, an input device, a display unit and the Internet. The computer further comprises a microprocessor. The microprocessor is connected to a communication bus. The computer also includes a memory. The memory may include Random Access Memory (RAM) and Read Only Memory (ROM). The computer system further comprises a storage device. The storage device can be a hard disk drive or a removable storage drive such as a floppy disk drive, optical disk drive, etc. The storage device can also be other similar means for loading computer programs or other instructions into the computer system. The computer system also includes a communication unit. The communication unit allows the computer to connect to other databases and the Internet through an I/O interface. The communication unit allows the transfer as well as reception of data from other databases. The communication unit may include a modem, an Ethernet card, or any similar device which enables the computer system to connect to databases and networks such as LAN, MAN, WAN and the Internet. The computer system facilitates inputs from a user through input device, accessible to the system through I/O interface.

The computer system executes a set of instructions that are stored in one or more computer usable mediums, in order to process input data. The storage elements may also hold data or other information as desired. The storage element may be in the form of an information source or a physical memory element present in the processing machine.

The set of instructions may include various commands that instruct the processing machine to perform specific tasks such as the steps that constitute the method of the present invention. The set of instructions may be in the form of a software program. Further, the software may be in the form of a collection of separate programs, a program module with a larger program or a portion of a program module, as in the present invention. The software may also include modular programming in the form of object-oriented programming. The processing of input data by the processing machine may be in response to user commands, results of previous processing or a request made by another processing machine.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for correcting a linearity error in an electrophotographic device, the electrophotographic device being used for processing data comprising a plurality of pels, each of the plurality of pels comprising a plurality of time-slices, the method comprising:

computing one or more total time-slices corresponding to one or more regions of the data, each of the one or more regions of the data comprising a predefined number of pels, the computation being performed based on a first predefined criterion;

adding a plurality of random numbers from a generated matrix to the one or more total time-slices;

computing a plurality of scan insertion vectors based on the addition of the plurality of random numbers to the one or more total time-slices, each of the plurality of scan insertion vectors describing a single scan line of data and each of the plurality of scan insertion vectors comprising a plurality of tokens, wherein the plurality of tokens corresponds to the one or more regions of the data;

inserting one or more time-slices in the one or more regions of the data based on the plurality of tokens, the one or more time-slices being inserted in a predefined order, wherein the insertion of the one or more time-slices corrects the linearity error in the electrophotographic device; and storing the plurality of scan insertion vectors in a memory;

wherein a predefined number of unique scan insertion vectors of the plurality of scan insertion vectors are stored in the memory.

2. The method according to claim 1 further comprising computing the one or more time-slices in each of the plurality of pels, the computation being performed based on a second predefined criterion.

3. The method according to claim 2, wherein the second predefined criterion is based on one or more properties of the electrophotographic device and one or more properties of the data.

4. The method according to claim 1, wherein the first predefined criterion is based on the one or more properties of the electrophotographic device.

5. The method according to claim 1, wherein at least one of the plurality of random numbers is added to each of the one or more total time-slices.

6. The method according to claim 1, wherein each of the plurality of scan insertion vectors corresponds to at least one of the one or more regions of the data.

7. The method according to claim 1, wherein each of the one or more total time-slices comprises one or more time-slices in the predefined number of pels and one or more time-slices to be inserted in the corresponding one or more regions of the data.

8. The method according to claim 7, wherein the plurality of random numbers are added to the one or more time-slices to be inserted in the one or more regions of the data.

9. The method according to claim 1, wherein the predefined order of insertion is based on the plurality of random numbers.

10. The method according to claim 1, wherein the one or more time-slices are inserted in between two pels in the one or more regions.

11. The method according to claim 1 further comprising storing the plurality of random numbers in a matrix, wherein a plurality of elements of the matrix is added to the one or more time-slices to be inserted in the one or more regions of the data, with only one element of the matrix being added to the one or more time-slices in a single region of the data.

12. The method according to claim 1, wherein adding a plurality of random numbers to the one or more total time-slices varies across a plurality of scan lines of the data and within the single scan line of data.

13. The method according to claim 1, wherein the computing the plurality of scan insertion vectors is based on computing a derivative of a scan position with respect to a change in scanner angle.

14. A method for correcting a linearity error in an electrophotographic device, the electrophotographic device being used for processing data comprising a plurality of pels, each of the plurality of pels comprising a plurality of time-slices, the method comprising:

computing one or more total time-slices corresponding to one or more regions of the data, each of the one or more regions of the data comprising a predefined number of pels, the computation being performed based on a first predefined criterion;

adding a plurality of random numbers from a generated matrix to the one or more total time-slices;

computing a plurality of scan insertion vectors based on the addition of the plurality of random numbers to the one or more total time-slices, each of the plurality of scan insertion vectors describing a single scan line of data and each of the plurality of scan insertion vectors comprising a plurality of tokens, wherein the plurality of tokens corresponds to the one or more regions of the data;

inserting one or more time-slices in the one or more regions of the data based on the plurality of tokens, the one or more time-slices being inserted in a predefined order, wherein the insertion of the one or more time-slices corrects the linearity error in the electrophotographic device;

storing the plurality of scan insertion vectors in a memory;

storing the plurality of random numbers in a matrix, wherein a plurality of elements of the matrix is added to the one or more time-slices to be inserted in the one or more regions of the data, with only one element of the matrix being added to the one or more time-slices in a single region of the data; and selecting the plurality of elements in such a way that a sum of the plurality of random numbers across each row is zero.

15. A method for correcting a linearity error in an electrophotographic device, the electrophotographic device being used for processin data comprising a plurality of pels each of the plurality of pels comprising a plurality of time-slices, the method comprising:

computing one or more total time-slices corresponding to one or more regions of the data, each of the one or more regions of the data comprising a predefined number of pels, the computation being performed based on a first predefined criterion;

adding a plurality of random numbers from a generated matrix to the one or more total time-slices;

computing a plurality of scan insertion vectors based on the addition of the plurality of random numbers to the one or more total time-slices, each of the plurality of scan insertion vectors describing a single scan line of data and each of the plurality of scan insertion vectors comprising a plurality of tokens, wherein the plurality of tokens corresponds to the one or more regions of the data;

inserting one or more time-slices in the one or more regions of the data based on the plurality of tokens, the one or more time-slices being inserted in a predefined order, wherein the insertion of the one or more time-slices corrects the linearity error in the electrophotographic device; and storing the plurality of scan insertion vectors in a memory;

wherein each of the plurality of scan insertion vectors is unique with respect to each other and accessed from the memory before scanning of the data begins.

* * * * *